US011499549B2

(12) United States Patent
Barbour

(10) Patent No.: US 11,499,549 B2
(45) Date of Patent: Nov. 15, 2022

(54) PROGRESSING CAVITY PUMP AND METHODS OF OPERATION

(71) Applicant: ACTIVATE ARTIFICIAL LIFT INC., Lloydminster (CA)

(72) Inventor: Stephen Barbour, Lloydminster (CA)

(73) Assignee: Activate Artificial Lift Inc., Lloydminster (CA)

( * ) Notice: Subject to any disclaimer, the term of this patent is extended or adjusted under 35 U.S.C. 154(b) by 77 days.

(21) Appl. No.: 16/308,681

(22) PCT Filed: Jun. 5, 2017

(86) PCT No.: PCT/CA2017/050684
§ 371 (c)(1),
(2) Date: Dec. 10, 2018

(87) PCT Pub. No.: WO2017/210779
PCT Pub. Date: Dec. 14, 2017

(65) Prior Publication Data

US 2019/0195220 A1 Jun. 27, 2019

Related U.S. Application Data

(60) Provisional application No. 62/348,489, filed on Jun. 10, 2016.

(51) Int. Cl.
*F04C 2/107* (2006.01)
*F04C 14/18* (2006.01)
(Continued)

(52) U.S. Cl.
CPC ..... *F04C 2/107* (2013.01); *F04C 2/1071* (2013.01); *F04C 13/008* (2013.01);
(Continued)

(58) Field of Classification Search
CPC ..... F04C 2/107; F04C 2/1071; F04C 13/008; F04C 14/185; F04C 2230/60–602;
(Continued)

(56) References Cited

U.S. PATENT DOCUMENTS 1,892,217 A * 12/1932 Moineau ..... F01C 1/107 74/458
2,957,427 A * 10/1960 O'Connor ..... F04C 2/1073 418/48
(Continued)

FOREIGN PATENT DOCUMENTS

CA 2299765 2/2000
CA 2264467 9/2000
(Continued)

OTHER PUBLICATIONS

Gerhard Vetter and Wolfgang Wirth, Understanding Processing Cavity Pumps Characteristics and Avoid Abrasive Wear, Proceedings of the Twelfth International Pump Users Symposium, Mar. 14-16, 1995, pp. 47-59, Turbomachinery Laboratories, Department of Mechanical Engineering, Texas A&M University, College Station.
(Continued)

*Primary Examiner* — Alexander B Comley
(74) *Attorney, Agent, or Firm* — Robert A. Nissen

(57) ABSTRACT

A progressing cavity pump has: a stator; a rotor; the rotor having a first axial operating position within the stator in which a first axial part of the rotor aligns with a first axial part of the stator to form an active pump section adapted to generate a pumping force on rotation of the rotor in the stator; the rotor having a second axial operating position within the stator in which the first axial part of the rotor aligns with a second axial part of the stator to form an active pump section adapted to generate a pumping force on rotation of the rotor in the stator. A related method is disclosed.

20 Claims, 3 Drawing Sheets

(51) Int. Cl.
*F04C 13/00* (2006.01)
*F04C 15/00* (2006.01)

(52) U.S. Cl.
CPC ..... *F04C 14/185* (2013.01); *F04C 15/00* (2013.01); *F04C 2230/80* (2013.01)

(58) Field of Classification Search
CPC .... F04C 2240/20; F01C 1/101; E21B 43/126; E21B 43/13
USPC ..... 418/28, 48, 107
See application file for complete search history.

(56) References Cited

U.S. PATENT DOCUMENTS 3,139,035 A * 6/1964 O'Connor ..... F04C 2/1073 418/1
3,435,772 A * 4/1969 Schlecht ..... F04C 2/1075 418/48
3,912,426 A * 10/1975 Tschirky ..... F04C 2/1075 418/48
4,415,316 A * 11/1983 Jurgens ..... E21B 4/02 418/48
4,580,955 A * 4/1986 Karge ..... E21B 43/126 418/5
4,764,094 A * 8/1988 Baldenko ..... F01C 11/002 418/5
4,957,161 A * 9/1990 Cholet ..... E21B 43/121 166/105
5,120,204 A * 6/1992 Mathewson ..... F04C 2/1073 418/178
5,209,294 A * 5/1993 Weber ..... E21B 43/121 166/105
5,722,820 A * 3/1998 Wild ..... F04C 2/1073 418/153
6,318,462 B1 11/2001 Tessier
6,338,388 B1 * 1/2002 Winkler ..... E21B 43/126 166/382
6,358,027 B1 * 3/2002 Lane ..... F04C 2/1071 418/1
6,457,958 B1 * 10/2002 Dunn ..... F04C 2/1071 418/1
7,201,222 B2 * 4/2007 Kanady ..... E21B 43/126 166/105
2002/0014335 A1 2/2002 Doyle et al.
2003/0188861 A1 10/2003 Doyle et al.
2009/0126924 A1 * 5/2009 Zarowny ..... E21B 43/126 166/68
2010/0322808 A1 * 12/2010 Guidry, Jr. ..... F04C 15/0073 418/48
2010/0329913 A1 * 12/2010 Ree ..... F04C 13/008 418/48
2014/0158426 A1 * 6/2014 Hay ..... E21B 4/02 175/17
2016/0040480 A1 * 2/2016 Evans ..... F04C 13/008 175/107
2016/0108912 A1 4/2016 Barbour
2018/0003174 A1 * 1/2018 Ba ..... F04C 2/1075

FOREIGN PATENT DOCUMENTS

CA 2474991 1/2006
CA 2912803 11/2014
CA 3026754 12/2017
WO 2010100134 9/2010
WO 2014186859 11/2014

OTHER PUBLICATIONS

International Search Report, International Application No. PCT/CA2017/050684, International Filing Date Jun. 5, 2017, 3 pages.

* cited by examiner

PROGRESSING CAVITY PUMP AND METHODS OF OPERATION

TECHNICAL FIELD

This document relates to progressing cavity pumps and methods of operation.

BACKGROUND

Progressing cavity pumps are known whose lifespan can be extended by initially using a first rotor to engage a first part of the stator, then pulling and replacing the first rotor with a second rotor that engages a second part of the stator.

SUMMARY

A method is disclosed for operating a progressing cavity pump in a borehole, the progressing cavity pump having a rotor within a stator, the method comprising: axially translating the rotor, relative to the stator, from a first operating position within the stator to a second operating position within the stator; in which, when the rotor is in the first operating position a first axial part of the rotor aligns with a first axial part of the stator to form an active pump section adapted to generate a pumping force on rotation of the rotor in the stator; and in which, when the rotor is in the second operating position the first axial part of the rotor aligns with a second axial part of the stator to form an active pump section adapted to generate a pumping force on rotation of the rotor in the stator.

A progressing cavity pump is disclosed comprising: a stator; a rotor; the rotor having a first axial operating position within the stator in which a first axial part of the rotor aligns with a first axial part of the stator to form an active pump section adapted to generate a pumping force on rotation of the rotor in the stator; the rotor having a second axial operating position within the stator in which the first axial part of the rotor aligns with a second axial part of the stator to form an active pump section adapted to generate a pumping force on rotation of the rotor in the stator.

A progressing cavity pump in an oil or gas well comprises a stator and a rotor, the stator designed to have more than the required stages for the expected pressure resulting in extra length (for example double the stages of a conventional pump), the stator designed to have a constant diameter and eccentricity across its length, the first rotor designed to have active sections which the minor diameter is relatively large and has an interference fit with the stator and creates a seal, the first rotor also having inactive sections which the minor diameter is relatively small has a clearance fit and does not seal with the stator, the active and inactive sections of the first rotor may have equal or unequal lengths along the first rotor, the number of active and inactive sections along the first rotor may vary.

The stator may be connected to the lower end of a tubing string and inserted into a well bore. The first rotor may be connected to the lower end of a rod string and lowered into the tubing string, the rotor is positioned in the stator. Once the pump operates and wears out, the rotor may be lifted via a flush-by unit (or another means) the required distance to move the active sections of the rotor to the previously inactive sections of the stator, thereby restoring the pump. Alternatively, the first rotor may be retrieved from the well if the rotor has experienced significant wear, and a new rotor may be inserted into the stator to restore the pump. The new rotor may have active and inactive sections (sections with interference and clearance fit similar to first rotor) or the new rotor may have a uniform minor diameter that has an interference fit with the stator throughout.

A progressing cavity pump apparatus is disclosed for use in an oil well, comprising the following. A stator, connected to a tubing string, sized with extra stages (or lift). A first rotor connected to a rod string, the first rotor having a varying minor diameter such that multiple sections of the rotor have an interference fit with the stator and multiple sections have a clearance fit. The interference fit sections produce a pumping force and generate wear on the stator in these sections. The clearance fit sections only serve to transmit torque and do not have any interaction with the stator nor do they provide pumping work. The interference fit sections of the first rotor may vary in number and length across the rotor. The first rotor extends through the entire length of the stator. A first active position, that is activated upon the installation of the first rotor and is based on the interference fit of the rotor and stator. A second active position, that is activated once a flush-by unit pulls and sets the rod string upwards or downwards a predetermined distance to place the first rotor in the second active position. The distance will depend on the design of the rotor and stator. A third active position, that is activated once a by a flush-by unit pulls and sets the rod string upwards or downwards a predetermined distance to place the first rotor in the third active position. The distance will depend on the design of the rotor and stator. A second rotor, which is installed upon mechanical failure of the first rotor (wear). The second rotor may have varying minor diameter. The second rotor may have a constant minor diameter. The second rotor extends through the entire length of the stator A method is disclosed for operating a progressing cavity pump in an oil and gas well bore, comprising the following. Installing a stator on a tubing string, and placing tubing string in a well bore. Installing a first rotor on a rod string, and placing rod string in the tubing string, the rotor being positioned within the stator. The first rotor having multiple sections of interference fit with the stator (relatively large diameter) and multiple sections of clearance fit (relatively small diameter). The first rotor extending completely though the length of the stator. Locating the first rotor in a first active position with the stator. Rotating/operating the first rotor its first position such that a pumping force is generated. Lifting or lowering the rotor via a flush-by unit (or another means) a set distance so that the first rotor now activates sections of the stator that were previously inactive/operating as clearance fit. In one case a user locates the rotor initially in a higher position, followed by lowering the rotor to a lower position. The rotor is sized to extend across an axial length of the stator in the first operating position and the second operating position. Rotating/operating the first rotor in its second position such that a pumping force is generated. If it is found that the second position of the first rotor has poor pumping characteristics due to rotor wear, the first rotor may be removed from the well and replaced with a new rotor that has a constant minor diameter along its length (or replaced with a new rotor that has a varying diameter similar to the first rotor).

In various embodiments, there may be included any one or more of the following features: When the rotor is in the first operating position, a second axial part of the rotor aligns with the second axial part of the stator to form an inactive pump section. The first axial part of the rotor defines a first minor rotor diameter, the second axial part of the rotor defines a second minor rotor diameter, and the first minor rotor diameter is larger than the second minor rotor diameter.

When the rotor is in the first operating position: the first axial part of the rotor forms an interference fit with the first axial part of the stator; and the second axial part of the rotor forms a clearance fit with the second axial part of the stator. When the rotor is in the second operating position: the first axial part of the rotor forms an interference fit with the second axial part of the stator. The first axial part of the rotor comprises a plurality of first axial parts of the rotor. The second axial part of the rotor comprises a plurality of second axial parts of the rotor. The first axial part of the stator comprises a plurality of first axial parts of the stator. The second axial part of the stator comprises a plurality of second axial parts of the stator. First axial parts of the rotor and second axial parts of the rotor are arranged in alternating pairs along an axis of the rotor. First axial parts of the stator and second axial parts of the stator are arranged in alternating pairs along an axis of the stator. The first axial part of the stator defines a first minor stator diameter, the second axial part of the stator defines a second minor stator diameter, and the first minor stator diameter is equal to the second minor stator diameter. The first active section is a function of the first rotor position. The stator defines a uniform minor stator diameter across an axial length of the stator. Axially translating the rotor, relative to the stator, from the second operating position within the stator to a third operating position within the stator. When the rotor is in the third operating position a first axial part of the rotor, or another axial part of the rotor, aligns with a third axial part of the stator to form an active pump section adapted to generate a pumping force on rotation of the rotor in the stator. When the rotor is in the first and second operating positions the third axial part of the stator aligns with the rotor to form an inactive pump section. Axially translating the rotor from the first operating position to the second operating position further comprises axially translating the rotor in an uphole or downhole direction. The rotor is axially translated from the first operating position to the second operation position using a flush-by unit. While the rotor is in the first operating position, rotating the rotor relative the stator such that the first axial part of the rotor and the first axial part of the stator generate a pumping force. While the rotor is in the second operating position, rotating the rotor relative the stator such that the first axial part of the rotor and the second axial part of the stator generate a pumping force. The rotor is replaced with a second rotor. The second rotor defines a uniform minor diameter across an axial length of the second rotor. The second rotor has a varying minor diameter across an axial length of the second rotor. The progressing cavity pump assembly mounted to a tubing string in a borehole. Mounting the stator to a tubing string and inserting the stator into the borehole. Mounting the rotor to a rod string and inserting the rotor into the tubing string. The rotor has a helical body configuration, the helical body configuration having a number of helical lobes equal to n, and in which the stator has a helical cavity configuration, the helical cavity configuration having a number of helical lobes equal to n+1.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figures 1, 2, 3A, 3B, 4A, 4B:
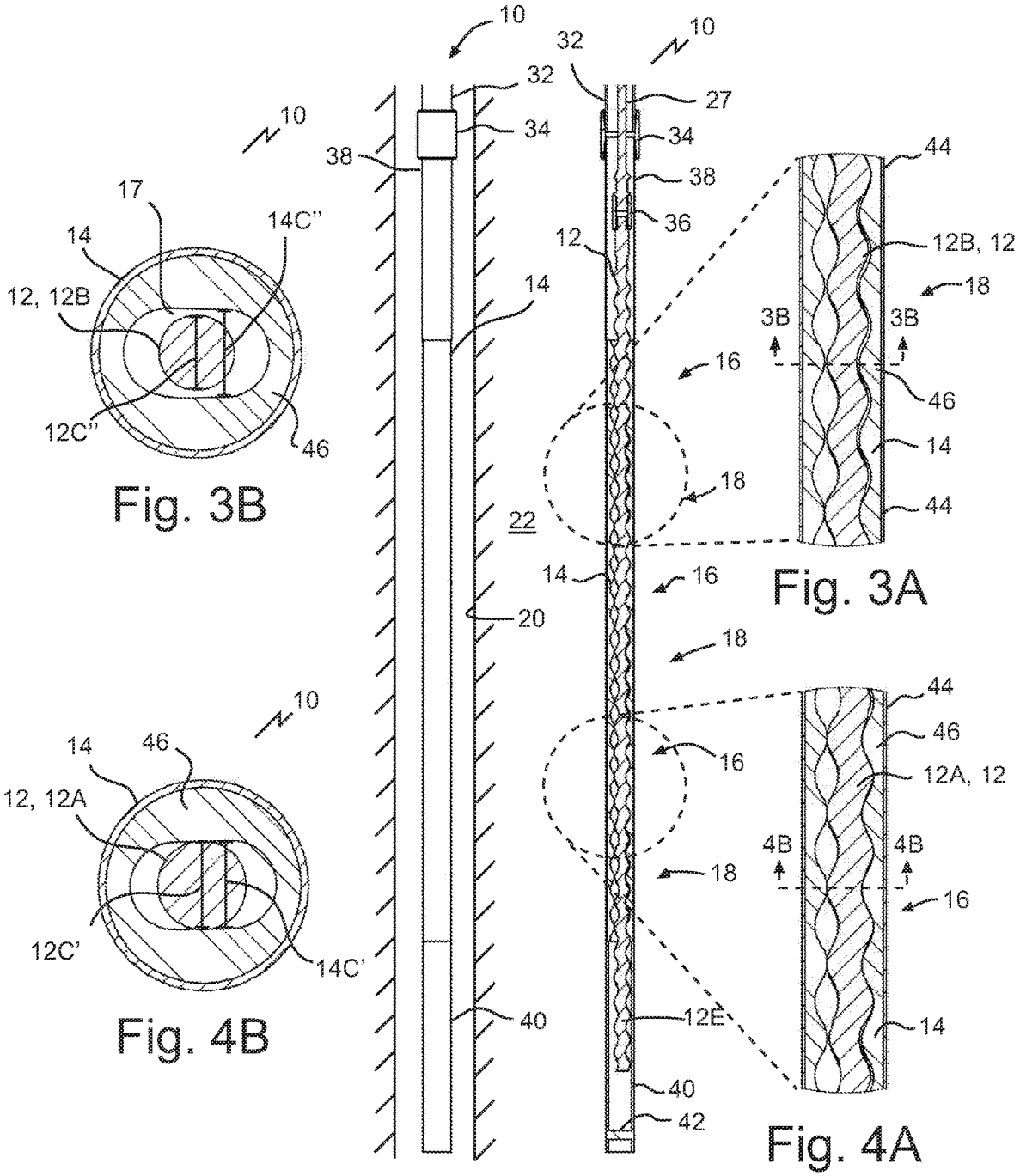
FIG. 1 is a side elevation view of a progressing cavity pump disposed in a borehole.
FIG. 2 is a section view of the progressing cavity pump shown in FIG. 1.
FIG. 3A is an exploded view of a highlighted area of the progressing cavity pump shown in FIG. 2 and forming a clearance fit.
FIG. 3B is a section view taken along the 3B-3B section lines of FIG. 3A.
FIG. 4A is an exploded view of a second highlighted area of the progressing cavity pump shown in FIG. 2 and forming an interference fit.
FIG. 4B is a section view taken along the 4B-4B section lines of FIG. 4A.

Referring to FIG. 2, a progressive or progressing cavity pump 10 is a form of positive displacement pump that is used in oil wells to lift produced fluid to surface and to market. A progressing cavity pump comprises a moving part, namely a rotor 12, which interfaces with a stationary part, namely a stator 14, to generate a pumping force. The rotor 12 may comprise a suitable composition such as a steel base that is chrome plated for wear resistance, although other material configurations may be used. Referring to FIG. 3A, the stator 14 may comprise a suitable composition such as a metal stator housing 44 lined internally with an elastomer 46, although other material configurations may be used.

Progressing cavity pumps 10 are used in oil wells due to their non-pulsating flow characteristics and ability to pump abrasive, high viscosity and high gas-volume-fraction emulsions. When pumping abrasive emulsions or fluids progressing cavity pumps may experience wear on the stator and in some cases the rotor along cavity seal lines. Over time such wear may cause the stator elastomer to wash out, reducing pump efficiency, and in the extreme case leading to a situation where the entire pump must be replaced. In high gas-volume-fraction emulsion applications, the compression of the gas as it progresses through the pump may generate heat and high pressure loading that vulcanizes and degrades the mechanical properties of the elastomer, resulting in premature pump failure. When the pump reduces in efficiency below a predetermined point, the pump is no longer effective and requires replacement, which in many applications is costly due to the complexity and difficulty associated with accessing and replacing the downhole pump.

Figure 8:
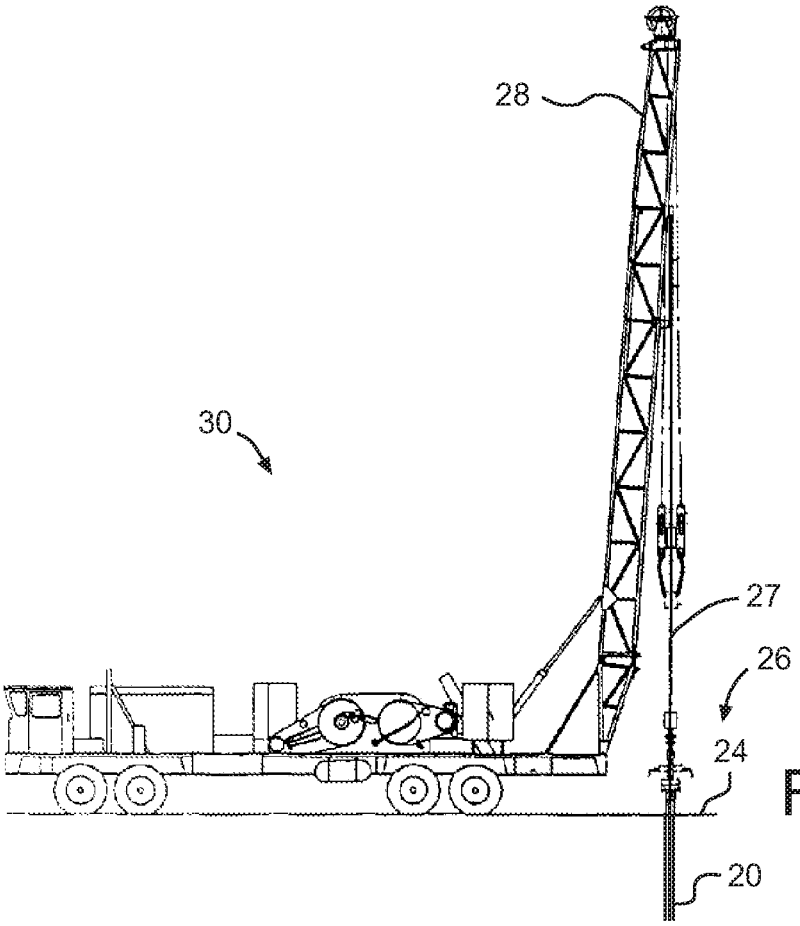
FIG. 8 is a side elevation view of a flush-by unit axially translating a rod string to carry out the disclosed method.

Referring to FIGS. 1, 2 and 8, a progressing cavity pump 10 may be installed in an oil well or a borehole 20. Referring to FIG. 8, a borehole 20 may penetrate a ground surface 24, with a wellhead 26 located above the surface 24 for accessing the borehole 20. The borehole 20 may be unlined or may be cemented in place with casing (not shown). Referring to FIG. 1, the borehole 20 may extend downhole a sufficient distance to access a formation 22, for example an oil-bearing formation.

Referring to FIG. 1, the stator 14 may be connected to the bottom of a tubing string 32. The stator 14 may be mounted on the tubing string 32 via a suitable connecting method such as a tubing collar 34 and a tubing joint 38. Referring to FIG. 2, the rotor 12 may be connected to the bottom of a rod string 27, which is enclosed within the tubing string 32. The rotor 12 may be mounted to the rod string 27 via a suitable connecting method such as by having an uphole end of the rotor 12 engage with a rod box 36.

To install the pump 10, a service rig (not shown) may be used to lower the stator 14 and tubing string 32 into the wellbore 20 to a downhole position adjacent to the formation 22. Once the tubing string is in place, the service rig may then lower the rotor 12 and rod string 27 into place within the stator 14. The rotor 12 may be located into an operating position within the stator 14 by a suitable method, such as by tagging the rotor 12 on a tag bar 42 below the stator 14. In the example shown in FIG. 2, tag bar 42 is located below stator 14 on a tubing joint 40 mounted to a downhole end of stator 14. In another case, a top tag (not shown) may be used to locate the rotor 12 into place.

In a conventional operation, when a progressing cavity pump stator 14 wears out and requires replacement, a service rig may be used to pull the rod and tubing strings 27 and 32, respectively, from the well to access and replace the pump stator. When just the rotor or rod string require replacement, a service rig may not be required and the operation may be conducted via a flush-by unit, with the tubing string remaining in place during the operation.

Figure 5:
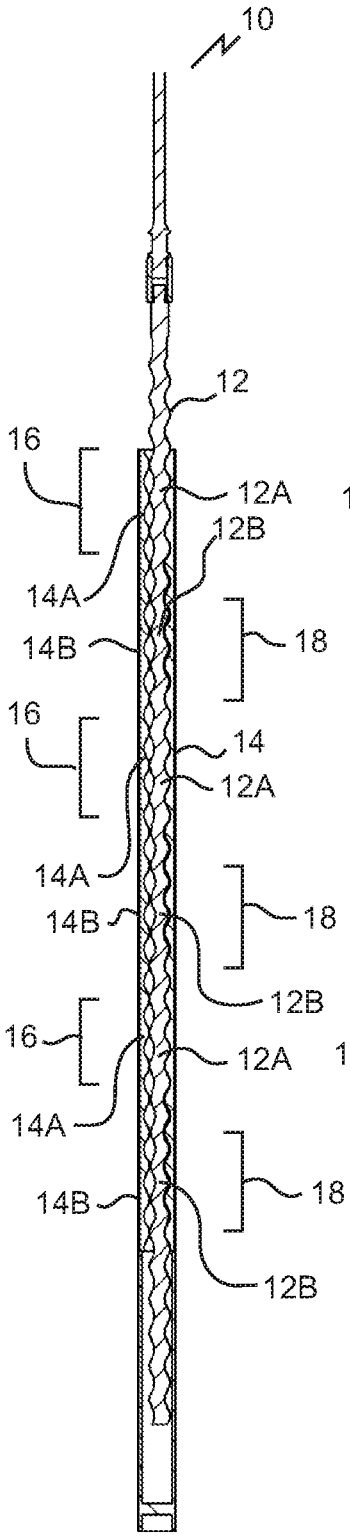
FIG. 5 is a section view of the progressing cavity pump shown in FIG. 1 with the rotor in a first operating position within the stator.

Referring to FIG. 2, in the progressing cavity pump 10 illustrated, rotor 12 and stator 14 are configured to work together in plural axial operating positions to extend the life of the pump 10 and to reduce servicing demands when the stator 14 wears out. Rotor 12 may be transitioned between first and second operating positions by axially translating rotor 12 relative to stator 14. Referring to FIG. 5, rotor 12 has a first axial operating position within stator 14 in which a first axial part or parts 12A of the rotor 12 align, for example mate, with a corresponding first axial part or parts 14A of the stator 14 to form an active pump section or sections 16. An active pump section 16 is adapted to generate a pumping force on rotation of the rotor 12 in the stator 14. Alignment of axial parts occurs when an axial part of the rotor and an axial part of the stator are radially adjacent one another in a plane perpendicular to an axis of the stator. Mating may occur when adjacent parts contact one another to form a seal.

Referring to FIG. 5, in the first axial operating position, a second axial part or parts 12B of the rotor 12 may align with a second axial part or parts 14B of the stator 14 to form an inactive pump section or sections 18. An inactive pump section 18 has no pumping effect when rotor 12 is rotating within stator 14, or may have a reduced pumping efficiency relative to the active pump sections 16. In some cases, a helical body part of the rotor 12 extends along the full axial length of the stator in one or both the first and second operating positions. Such a configuration avoids empty sections or cavities that would otherwise be created if the downhole end of the rotor terminated within the stator above the downhole end of the stator, or if parts of the rotor in the stator were separated by a relatively thinner connector such as a polished rod. Empty sections or cavities have been discovered to lead to a buildup of sand, which can plug or damage the pump 10.

Figure 6:
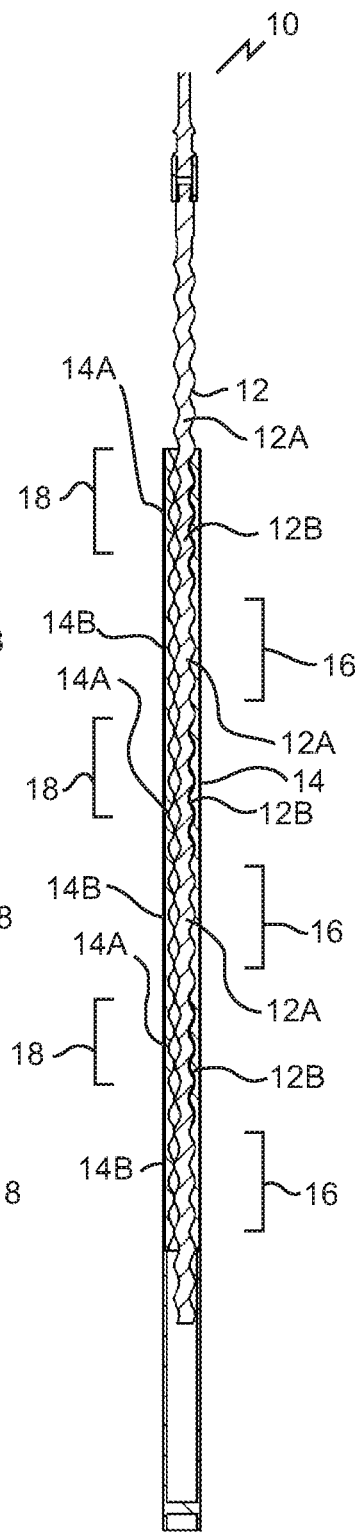
FIG. 6 is a section view of the progressing cavity pump shown in FIG. 1 with the rotor in a second operating position within the stator.

Referring to FIGS. 5 and 6, after operating the progressing cavity pump 10 in the first axial operating position (FIG. 5), the first axial part or parts 14A of the stator 14 may wear out. If such wear occurs, rotor 12 may be axially translated a distance sufficient to align the axial parts of the rotor 12 that previously formed active pump sections 16 with the axial parts of the stator 14 that previously formed inactive pump sections 18, thereby restoring pumping efficiency (FIG. 6). To transition the rotor 12 between operating positions, the rotor 12 is axially translated, for example in an uphole direction, relative to the stator 14 from the first axial operating position (FIG. 5) to a second axial operating position (FIG. 6). In the second axial operating position, the first axial part or parts 12A of the rotor 12 align with the second axial part or parts 14B of the stator 14 to form an active pump section or sections 16.

When axial translation of the rotor is used to restore pumping efficiency, expenses can be reduced relative to the practices of pulling the entire tubing and/or rod strings disclosed. For example, referring to FIGS. 2, 5 and 6, when rotor 12 and stator 14 are configured to operate in the fashion disclosed in this document, once an axial part of the stator 14 wears out, a different axial part of stator 14 can be engaged via translation of rotor 12 without having to first remove rotor 12. Referring to FIG. 8, axial translation of the rotor 12 may be accomplished via a flush-by unit 30, for example using a mast 28 and suitable support equipment, for example located on a tractor trailer (shown), skid, or flatbed truck. The operation of a flush-by unit is relatively less expensive than the operation of a servicing rig, particularly when comparing a) the cost to pull a tubing string 32 with a servicing rig and b) the cost to pull the relatively lighter rod string 27 with a flush-by unit. A flush by unit is less powerful and smaller than a service rig. A flush by unit is an example of a device that is able to pull a rod string, but not a tubing string, out of a well. By contrast a service rig can pull either rod or tubing, and may be used for the axial translation stage in some cases. Other translation mechanisms may be used, such as a crane, or a mechanism that is permanently or transiently attached at surface to lift the rod. In one case a device may be used that permits the rod to be incrementally adjusted up or down at the surface, for example using a suitable actuator such as a ratchet, hydraulic piston/cylinder, slip, screw actuator, or other system. A pony rod may be used at the top of the rod string, for example with a length commensurate or equivalent to the axial translation distance required to switch the rotor between axial positions. By lifting the rod string and removing the pony rod, the rotor is axially translated the required distance to switch positions. In cases where the rotor must be lowered to switch positions, a pony rod may be added instead of removed.

Referring to FIGS. 3A-B and 4A-B, a suitable mechanism may be used to configure the rotor 12 and stator 14 to operate in the fashion disclosed in this document. In one case, the different axial parts of the rotor 12 differ in diameter relative to one another. Referring to FIG. 4B, first axial part 12A of the rotor 12 may define a first minor rotor diameter 12C'. Referring to FIG. 3B, second axial part 12B of the rotor 12 may define a second minor rotor diameter 12C". First minor rotor diameter 12C' of FIG. 4B may be larger than second minor rotor diameter 12C" of FIG. 3B. Referring to FIG. 4B, first axial part 14A of the stator 14 may define a first minor stator diameter 14C'. Referring to FIG. 3B, second axial part 14B of the stator 14 may define a second minor stator diameter 14C". The minor stator diameter 14C' of FIG. 4B may be equal to the minor stator diameter 14C" of FIG. 3B. Thus, stator 14 may define a uniform minor stator diameter 14C across an axial length of stator 14. Other diameter ratios and configurations may be used.

In one case, when different axial parts of the rotor 12 differ in diameter relative to one another, alignment of those axial parts within the stator 14 may form different fits, which generate different respective amounts of pumping force under similar operating conditions. Referring to FIG. 5, when rotor 12 is in the first axial operating position, first axial part 12A of the rotor 12 may form an interference fit with first axial part 14A of the stator 14. In the first operating position second axial part 12B of the rotor 12 may form a clearance fit with second axial part 14B of the stator 14. Referring to FIG. 6, when rotor 12 is in the second axial operating position, first axial part 12A of the rotor 12 may form an interference fit with second axial part 14B of the stator 14. When in the second operating position the second axial part 12B of the rotor 12 may form a clearance fit with the first axial part 14A of the stator 14.

Rotation of the rotor 12 in the stator 14 creates the desired pumping action, and different types of fit affect the respective pumping action across the respective sections of the pump. Referring to FIG. 5, when rotor 12 is in the first axial operating position, first axial part 12A of the rotor 12 and first axial part 14A of the stator 14 generate a pumping force when rotor 12 is rotated relative to stator 14. Referring to FIG. 6, first axial part 12A of the rotor 12 and second axial part 14B of the stator 14 generate a pumping force when rotor 12 is rotated relative to stator 14. The pumping force generated by sections of the pump that form an interference fit is greater than the pumping force generated by sections that form a clearance fit. Referring to FIG. 4B, an interference fit may include a fit in which the minor rotor diameter 12C' is equal to or slightly larger than the minor stator diameter 14C'. In the case of a slightly larger minor rotor diameter 12C', stator elastomer 46 deforms around rotor 12 and creates a seal line as rotor 12 rotates within stator 14. Referring to FIG. 3B, by contrast, with a clearance fit, the rotor 12 and stator 14 may be out of contact and form a clearance gap 17, thus preventing the formation of a seal and reducing and in some cases creating nominal to no pumping action across the clearance section. The use of a clearance fit reduces the friction, loading, abrasion and gas compression within the clearance section than would otherwise be created by an interference fit.

Referring to FIGS. 5 and 6, in the progressing cavity pump 10 illustrated a plurality of first and second axial parts of the rotor 12 and a plurality of first and second axial parts of the stator 14, respectively, are configured to work together in a suitable fashion. There may be a plurality of first axial parts 12A of the rotor 12 and a plurality of second axial parts 12B of the rotor 12 arranged in alternating pairs along an axis of rotor 12. In one case there is an alternating sequence of first axial parts 12A of the rotor 12 and second axial parts 12B of the rotor 12 arranged along an axis of rotor 12 as follows: 12A-12B-12A-12B, for a suitable number of pairs. There may be a plurality of first axial parts 14A of the stator 14 and a plurality of second axial parts 14B of the stator 14 arranged in alternating pairs along an axis of stator 14, with the alternating pairs of stator parts corresponding with the positioning of the alternating pairs of rotor parts. There may be an alternating sequence of first axial parts 14A of the stator 14 and second axial parts 14B of the stator 14 arranged along an axis of stator 14 as follows: 14A-14B-14A-14B, for a suitable number of pairs. Other arrangements may be used for situations where plural axial parts are present in the rotor and stator.

Figure 7:
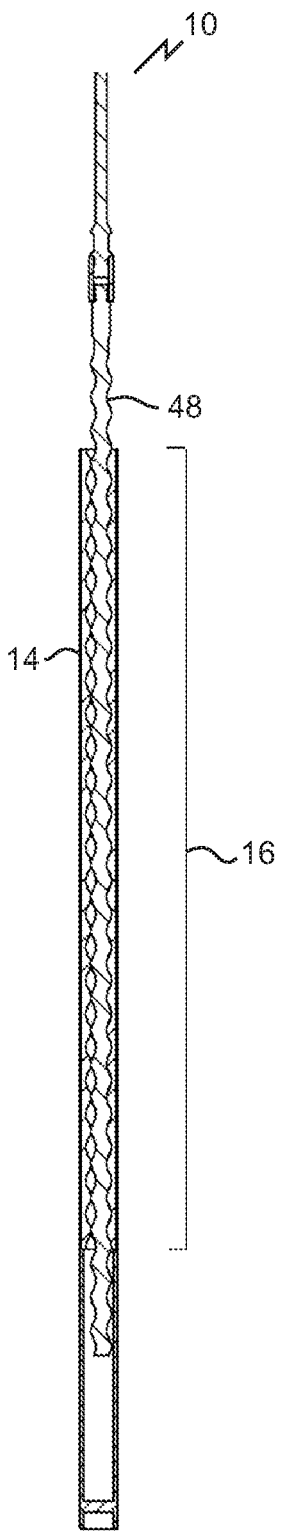
FIG. 7 is a section view of the progressing cavity pump shown in FIG. 1 with the first rotor removed and replaced with a second rotor within the stator.

In some cases rotor 12 will experience wear as the pumping operation proceeds, which may reduce pump efficiency in a fashion similar to the reduced efficiency that occurs when the stator 14 wears out. Referring to FIG. 7, once the rotor 12 (not shown) is worn, the rotor 12 may be retrieved from the borehole and a second rotor 48 may be inserted into stator 14 to restore pump efficiency. In the case shown, second rotor 48 has a uniform minor diameter that forms an interference fit with stator 14 throughout the axial length of stator 14. In other cases, second rotor 48 may have a variable minor diameter that forms active pump sections 16 (sections with interference fit) and inactive pump sections 18 (sections with clearance fit) with stator 14.

Referring to FIGS. 5 and 6, in one case the rotor 12 extends along the entire axial length of the stator, such that the length of the rotor 12 is equal to or greater than the length of the stator. In a further case the rotor 12 may extend along the entire axial length of the stator in both the first and second operating positions, making the rotor 12 longer than the stator. A downhole part of the rotor 12 may extend below a downhole end of the stator in one or both operating positions as shown. Referring to FIG. 2, rotor 12 may have an axial part 12E that extends downhole past the downhole end of stator 14 in at least the initial operating position. In subsequent operating positions, axial part 12E of the rotor 12 may align with an axial part of the stator 14 to form an active pump section 16. When a rotor of a progressing cavity pump does not extend through the entire axial length of the stator, inflow problems to the pump intake, or sand settling problems at the pump discharge may arise depending on the configuration of the pump. When rotor 12 and stator 14 are configured to operate in the fashion disclosed in this document, such problems may be mitigated.

Figure 9A:
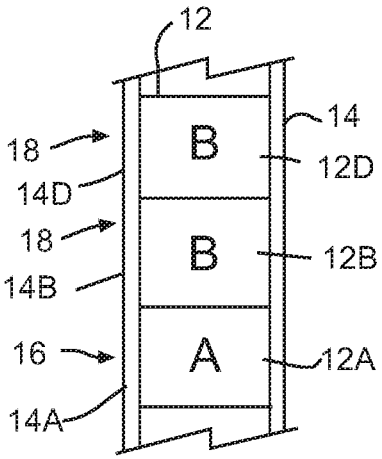
FIGS. 9A-C are side elevation views of a rotor in three respective axial operating positions within a stator of a progressing cavity pump.
Figure 9B:
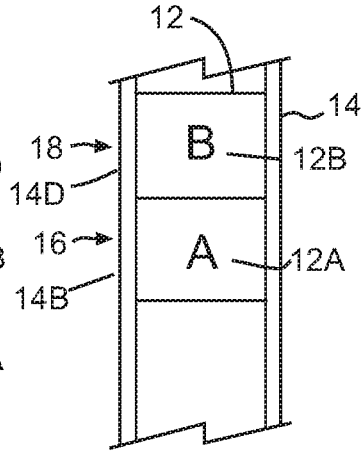
Figure 9C:
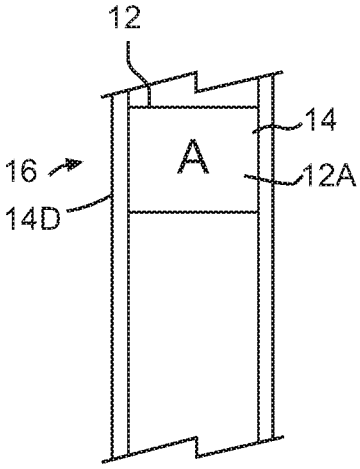

Referring to FIGS. 9A-C, in some cases the rotor axially translated from the first axial operating position to the second axial operation position (FIGS. 9A-B) and from the second axial operating position to a third axial operating position (FIGS. 9B-C), for example using a flush-by unit 30 (FIG. 8). Referring to FIGS. 9B-C, rotor 12 may be axially translated, for example in an uphole direction, relative to stator 14 from the second axial operating position (FIG. 9B) to the third axial operating position (FIG. 9C). Referring to FIG. 9C, in the third axial operating position, first axial part or parts 12A of the rotor 12 may align with a third axial part or parts 14D of the stator 14 to form an active pump section or sections 16 adapted to generate a pumping force on rotation of rotor 12 in stator 14. In the third operating position, a second axial part or parts 12B (not shown) of the rotor 12 may align with first axial part or parts 14A (not shown) or second axial part or parts 14B (not shown) of the stator 14 to form an inactive pump section or sections 18. Referring to FIG. 9B, in the second operating position, second axial part or parts 12B of the rotor 12 may align with third axial part or parts 14D of the stator 14 to form an inactive pump section or sections 18. When rotor 12 is in the first or second axial operating positions, the third axial part or parts 14D of the stator 14 may align with rotor 12, such as third axial part or parts 12D of rotor 12, to form an inactive pump section or sections 18.

Referring to FIG. 2, the ability of a progressing cavity pump 10 to operate against pressure is a function of the number of stages within the pump. A stage is equal to one pitch length of stator 14 and as the number of stages increases, the stator length and total pressure capacity increase proportionally. The number of stages in progressing cavity pump 10 may be chosen based on the required discharge pressure in which progressing cavity pump 10 will operate. The pumps 10 disclosed here may have a suitable number of stages forming active sections in each operating position to achieve a predetermined minimum pumping pressure in each respective operating position.

Referring to FIGS. 2, 3A-B and 4A-B, rotor 12 may have a helical body configuration and stator 14 may have a helical cavity configuration. Together, the helical body configuration of rotor 12 and the helical cavity configuration of stator 14 may form corresponding lobe ratios in which stator 14 has 1 lobe more than rotor 12. For example, if rotor 12 has a single-lobed helical body configuration, then stator 14 will have a double-lobed helical cavity configuration. When mated, the single-lobed rotor 12 and the double-lobed stator 14 form a 1:2 geometry having discrete cavities between rotor 12 and stator 14. When rotor 12 is rotated relative to stator 14, the cavities progress against a pressure gradient to the discharge of stator 14 and thus, a pumping force is generated. Rotor 12 may be rotated in an oil well via a motor, such as a drivehead (not shown), at surface 24 (FIG. 8). In another case, the helical geometry of progressing cavity pump 10 may also be of the order of 2:3 or 3:4, as described in Moineau's patent U.S. Pat. No. 1,892,217. Other lobe ratios may be used.

In some cases rotor 12 is axially translated in a downhole direction, relative to stator 14, to engage different axial parts of stator 14 and achieve a second or subsequent operating position. Rotor 12 may be mounted to flush-by unit 30 and/or the surface motor via rod (shown in FIG. 2) or tubing (not shown). Stator 14 may have a variable minor stator diameter (not shown). For example, minor stator diameter 14C may increase in diameter in an uphole direction to accommodate first axial parts 12A of different minor diameters 12C. Rotor 12 may have a third axial part or parts that align with a third axial part or parts of the stator 14 in the first operating position.

When the rotor is in an operating position, a drivehead (not shown) may be coupled to the rod to rotate the rod and drive the pump. The drivehead may need to be disconnected from the rod before axial translation may occur. Once the rotor is translated into the new operating position, the drivehead (or a replacement drivehead) may be connected to the rod to rotate the rotor in the new operating position. Various other steps may be carried out in association with the axial translation step. For example, surface equipment such as stuffing boxes and valves may be removed to permit access to the rod prior to translation, and such equipment may then be re-installed once the rotor is in the new operating position, to set the well back up for production. An operating position may refer to the fact that the rod string, pump, drivehead and surface equipment are coupled together to produce fluids from the well.

Stator 14 may be designed to have more than the required stages for creating a desired operating pressure when operated with a conventional rotor, resulting in extra axial length, for example double the stages of a conventional pump. Stator 14 may be designed to have a constant minor diameter 14C and eccentricity across its axial length, although such are not requirements in all cases. Active sections 16 and inactive sections 18 of rotor 12 may have equal or unequal axial lengths along rotor 12. The number of active sections 16 and inactive sections 18 formed along the first rotor 12 may vary. Pump 10 and the methods disclosed here may be used in suitable wells, such as oil, gas, oil and gas, water, and other well types. An interference fit may be achieved by a suitable method, such as using a rotor that has slightly larger dimensions than the stator, or by skewing the eccentricity of the rotor or stator. The length of axial parts of the rotor may be sufficiently long to allow for rotor drift as the rod string stretches periodically under load. For example, the rotor axial parts may be longer or shorter than corresponding axial parts of the stator. In some cases an elastomer may be omitted in the stator, for example if the pump creates a metal to metal seal between rotor and stator. Parts of the rotor and stator may form active sections in both operating positions, and parts may form inactive sections in both operating positions, in some cases, although the brackets for sections 16 and 18 in FIGS. 5 and 6 are drawn to delineate only parts that switch from active to inactive.

Directional terms such as "top", "bottom", "downhole", and "uphole", are used in the following description for the purpose of providing relative reference only, and are not intended to suggest any limitations on how any article is to be positioned during use, or to be mounted in an assembly or relative to an environment or the direction of gravity on the earth. The terms "uphole" and "top" refer to portions of a structure that when installed in a vertical wellbore are closer to the surface than other portions of the structure based on the vertical distance between a portion of the structure and the surface, and the terms "downhole" and "bottom" refer to portions of a structure that when installed in a vertical wellbore are further away from the surface than other portions of the structure based on the vertical distance between a portion of the structure and the surface. The terms "uphole" and "top" refer to portions of a structure that when installed in a horizontal wellbore are closer to the surface than other portions of the structure based on the path formed by the wellbore, and the terms "downhole" and "bottom" refer to portions of a structure that when installed in a horizontal wellbore are further away from the surface than other portions of the structure based on the path formed by the wellbore. Although size comparisons are made in this document using minor diameters, major or other diameters may be used as appropriate.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A method for operating a progressing cavity pump in a borehole, the progressing cavity pump having a rotor within a stator, the method comprising: while the rotor is in a first operating position within the stator, rotating the rotor relative the stator, with a first axial part of the rotor aligning with a first axial part of the stator to form an active pump section, and a second axial part of the rotor aligning with a second axial part of the stator to form an inactive pump section with reduced pumping efficiency relative to the active pump section, wherein rotating the rotor relative to the stator when in the first operating position generates a pumping force between the first axial part of the rotor and the first axial part of the stator; axially translating the rotor, relative to the stator, from the first operating position within the stator to a second operating position within the stator, wherein the rotor is axially translated using equipment, at a ground surface penetrated by the borehole, to raise or lower the rotor; and while the rotor is in the second operating position within the stator, rotating the rotor relative to the stator, with the first axial part of the rotor aligning with the second axial part of the stator to form an active pump section, and the second axial part of the rotor and the first axial part of the stator forming inactive pump sections with reduced pumping efficiency relative to the active pump section, wherein rotating the rotor relative to the stator when in the second operating position generates a pumping force between the first axial part of the rotor and the second axial part of the stator.

2. The method of claim 1 wherein the first axial part of the rotor defines a first minor rotor diameter, the second axial part of the rotor defines a second minor rotor diameter, and the first minor rotor diameter is larger than the second minor rotor diameter.

3. The method of claim 1 wherein:

when the rotor is in the first operating position:

the first axial part of the rotor forms an interference fit with the first axial part of the stator; and the second axial part of the rotor forms a clearance fit with the second axial part of the stator; and when the rotor is in the second operating position:

the first axial part of the rotor forms an interference fit with the second axial part of the stator.

4. The method of claim 1 wherein:

the first axial part of the rotor comprises a plurality of first axial parts of the rotor;

the second axial part of the rotor comprises a plurality of second axial parts of the rotor;

the first axial part of the stator comprises a plurality of first axial parts of the stator; and the second axial part of the stator comprises a plurality of second axial parts of the stator.

5. The method of claim 4 wherein:

the first axial parts of the rotor and the second axial parts of the rotor are arranged in alternating pairs along an axis of the rotor; and the first axial parts of the stator and the second axial parts of the stator are arranged in alternating pairs along an axis of the stator.

6. The method of claim 1 wherein the rotor is longer than the stator and is sized to extend across an axial length of the stator in the first operating position and the second operating position.

7. The method of claim 1 wherein the first axial part of the stator defines a first minor stator diameter, the second axial part of the stator defines a second minor stator diameter, and the first minor stator diameter is equal to the second minor stator diameter.

8. The method of claim 7 wherein the stator defines a uniform minor stator diameter across an axial length of the stator.

9. The method of claim 1 wherein the method further comprises:

axially translating the rotor, relative to the stator, from the second operating position within the stator to a third operating position within the stator;

wherein, when the rotor is in the third operating position the first axial part of the rotor, aligns with a third axial part of the stator to form an active pump section adapted to generate a pumping force upon rotation of the rotor in the stator.

10. The method of claim 9 wherein, when the rotor is in the first and second operating positions the third axial part of the stator aligns with the rotor to form an inactive pump section.

11. The method of claim 1 wherein axially translating the rotor from the first operating position to the second operating position further comprises axially translating the rotor in an uphole direction.

12. The method of claim 1 wherein the rotor is axially translated from the first operating position to the second operation position using a flush-by unit.

13. The method of claim 1 further comprising replacing the rotor with a second rotor.

14. The method of claim 13 wherein the second rotor defines a uniform minor diameter across an axial length of the second rotor.

15. The method of claim 13 wherein the second rotor has a varying minor diameter across an axial length of the second rotor.

16. A progressing cavity pump comprising: a stator; a rotor; the rotor having a first axial operating position within the stator wherein a first axial part of the rotor aligns with a first axial part of the stator to form an active pump section adapted to generate a pumping force upon rotation of the rotor in the stator, and a second axial part of the rotor aligns with a second axial part of the stator to form an inactive pump section with reduced pumping efficiency relative to the active pump section; the rotor having a second axial operating position within the stator wherein the first axial part of the rotor aligns with the second axial part of the stator to form an active pump section adapted to generate a pumping force upon rotation of the rotor in the stator, and the second axial part of the rotor and the first axial part of the stator form inactive pump sections with reduced pumping efficiency relative to the active pump section; the first axial part of the rotor defining a first minor rotor diameter, the second axial part of the rotor defining a second minor rotor diameter, and the first minor rotor diameter being larger than the second minor rotor diameter; and wherein the progressing cavity pump is structured to be operated in both the first axial operating position and the second operating position to lift fluids in an oil well to a ground surface penetrated by a borehole, and to produce those fluids at the ground surface, and the rotor is structured to be axially translatable between the first axial operating position and the second axial operating position using equipment at, at the ground surface to raise or lower the rotor.

17. The progressing cavity pump of claim 16 wherein:

the stator defines a uniform minor stator diameter across an axial length of the stator.

18. The progressing cavity pump of claim 16 wherein:

when the rotor is in the first axial operating position:

the first axial part of the rotor forms an interference fit with the first axial part of the stator; and the second axial part of the rotor forms a clearance fit with the second axial part of the stator; and when the rotor is in the second axial operating position:

the first axial part of the rotor forms an interference fit with the second axial part of the stator.

19. The progressing cavity pump of claim 16 wherein:

the first axial part of the rotor comprises a plurality of first axial parts of the rotor;

the second axial part of the rotor comprises a plurality of second axial parts of the rotor;

the first axial part of the stator comprises a plurality of first axial parts of the stator; and the second axial part of the stator comprises a plurality of second axial parts of the stator.

20. An apparatus comprising the progressing cavity pump assembly of claim 16 mounted to a tubing string in a borehole.

* * * * *